US008079496B2

(12) United States Patent
Pakkert et al.

(10) Patent No.: US 8,079,496 B2
(45) Date of Patent: Dec. 20, 2011

(54) COMBINATION OF A DISPENSER AND CONTAINER FOR CARBONATED DRINK

(75) Inventors: Engbert Hermannes Pakkert, Delft (NL); Quintijn Innikel, Hilversum (NL)

(73) Assignee: Heineken Technical Services B.V., Zoeterwoude (NL)

( * ) Notice: Subject to any disclaimer, the term of this patent is extended or adjusted under 35 U.S.C. 154(b) by 1285 days.

(21) Appl. No.: 10/556,087

(22) PCT Filed: May 14, 2004

(86) PCT No.: PCT/NL2004/000332

§ 371 (c)(1),
(2), (4) Date: Nov. 21, 2006

(87) PCT Pub. No.: WO2004/101424

PCT Pub. Date: Nov. 25, 2004

(65) Prior Publication Data

US 2007/0056990 A1 Mar. 15, 2007

(30) Foreign Application Priority Data

May 14, 2003 (NL) ..... 1023429

(51) Int. Cl.
*B67D 7/80* (2010.01)
*B65D 83/00* (2006.01)

(52) U.S. Cl. ..... 222/146.6; 222/400.7; 222/394

(58) Field of Classification Search ..... 222/146.6, 222/400.7, 400.8, 133, 333, 183, 394, 399, 222/401, 505

See application file for complete search history.

(56) References Cited

U.S. PATENT DOCUMENTS

| | | | | |
|---|---|---|---|---|
| 2,675,822 | A * | 4/1954 | Redlin | 137/170.3 |
| 6,824,017 | B2 * | 11/2004 | Sluijter | 222/153.04 |
| 7,188,751 | B2 * | 3/2007 | Van Der Klaauw et al. | 222/146.6 |
| 2002/0050496 | A1 * | 5/2002 | Van Der Meer et al. | 222/105 |
| 2003/0071067 | A1 | 4/2003 | Sluijter | |
| 2004/0050879 | A1 | 3/2004 | Vlooswijk et al. | |

FOREIGN PATENT DOCUMENTS

| | | |
|---|---|---|
| NL | 1 019 054 | 3/2003 |
| WO | WO 02/42197 | 5/2002 |

* cited by examiner

*Primary Examiner* — Kevin P Shaver
*Assistant Examiner* — Stephanie E Williams
(74) *Attorney, Agent, or Firm* — Young & Thompson

(57) ABSTRACT

Combination of a dispenser (1) and container (7) for carbonated drink, the container being provided at the top with an outflow channel (10), extending in the direction of the central axis of the container, and a dispensing valve (11), closed under spring tension, for dispensing carbonated drink via a dispensing line (12, 13) connected to the outflow channel (10), the dispenser (1) being provided with a chill chamber (4) for accommodating the container (7) and with a dispensing head (15) with a handle (17) whereby the handle (17) is connected to an operating member (18, 20) that, during use, engages on the dispensing valve (11).

4 Claims, 8 Drawing Sheets

COMBINATION OF A DISPENSER AND CONTAINER FOR CARBONATED DRINK

Figure 1:
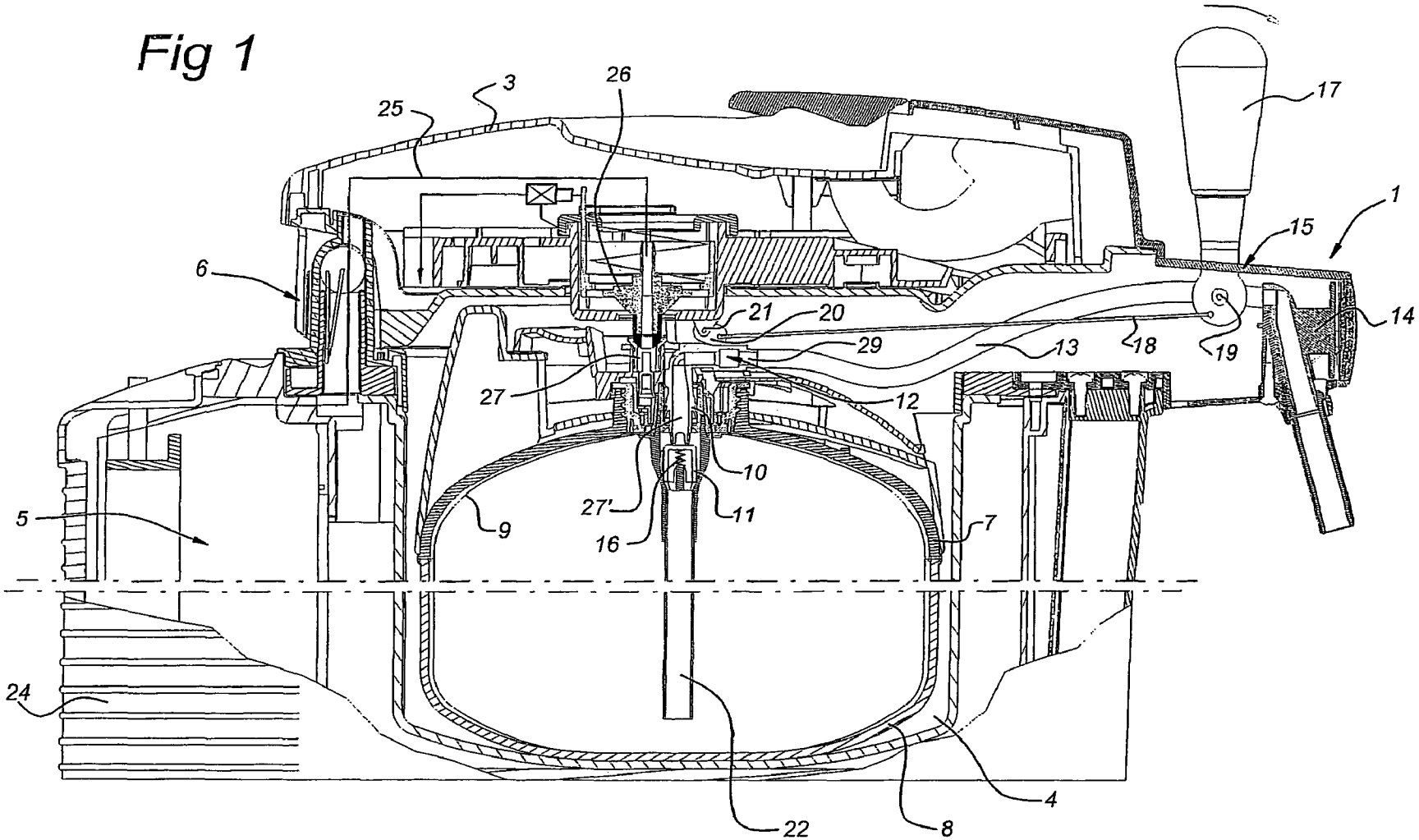

The invention relates to a combination of a dispenser and container for carbonated drink, the container being provided at a (sic) top with an outflow channel, extending in a direction of an axis of the container, and a dispensing valve, closed under spring tension, for dispensing carbonated drink via a dispensing line connected to the outflow channel, the dispenser being provided with a chill chamber for accommodating the container and with a dispensing head with a handle.

The invention also relates to a dispenser and to a container containing carbonated drink for use in such a combination.

Such a dispenser for carbonated drink, in particular beer, is disclosed in WO 00/03944 and in NL 1019054 in the name of the Applicant. The dispenser comprises a chill chamber with a lid and with a tap handle. An air feed, which is connected to a compressor, is accommodated in the lid. The container is formed by a plastic container with a flexible bag containing carbonated drink therein. The container is provided at the top with a fill and outflow channel that is closed off by a spring-loaded valve, and with an air inlet and with an air connection. A dispensing line is made up of a plastic elbow that is connected to a flexible dispensing line. A plastic shut-off valve is attached at the end of the dispensing line. The elbow is positioned in the outflow channel and can be moved downwards therein. When the container is placed in the dispenser, the plastic shut-off valve is fitted in the tap head so that it can be opened and closed via an operating member connected to the tap handle.

When the container is placed in the dispenser and the lid is closed, the air feed of the dispenser is connected to the air connection of the container. The elbow is also moved downwards in the outflow channel via a stop in the lid, for opening the spring-loaded valve. As a result carbonated drink is able to flow into the dispensing line as far as the plastic shut-off valve. Air is fed via the air connection into the space between the flexible bag and the wall of the container, so that the drink is driven out of the container. When the plastic shut-off valve is opened by operating the tap handle, carbonated drink is dispensed via the tap head.

Accurate dispensing of carbonated drink, in particular beer, is possible with the known drink dispenser. However, the construction of the plastic shut-off valve at the end of the flexible dispensing line is relatively complex.

Therefore, an aim of the invention is to provide a combination of a drink dispenser and a container for carbonated drink with which a relatively simple operating mechanism is provided for controlled drink dispensing.

To this end the combination of drink dispenser and a container for carbonated drink according to the invention is characterised in that the handle is connected to an operating member that, during use, engages on the dispensing valve or on the container, wherein the operating member can be moved by moving the handle in the direction of [lacuna] axis in order to open and to close the dispensing valve.

It has been found that accurate and controlled drink dispensing is possible by direct operation of the spring-loaded valve. With this arrangement the outflow end of the dispensing channel is in direct communication, that is to say without intermediate shut-off valve, with the outflow channel of the container. As a result the production of such a shut-off valve can be dispensed with. Since the dispensing line and shut-off valve in the known dispenser are preferably designed for one-off use, an appreciable saving in costs can be achieved by the invention. If the dispensing line is suitable for re-use, omission of the plastic shut-off valve results in a line that can be cleaned easily, as a result of which, especially if the carbonated drink is beer, the taste can be improved and the life can be extended.

In a preferred embodiment the dispensing head is provided with a pivot point, located some distance away from the axis, about which the handle can be moved, the operating member comprising a push body connected to the handle that engages on the strike surface. By means of the operating member the shut-off valve is moved downwards over a short stroke, the spring of the shut-off valve being pushed in. The stroke of the operating member can be accurately adapted to the pressure used for drink dispensing, the type of drink dispensed and the dimensions of the dispensing channel in order to obtain a desired flow on dispensing. This is important in particular if the drink is beer, in which case the formation of the correct amount of head when dispensing the drink is very important.

In order to guarantee straight-line movement of the striker limb and to prevent skewing on operation of the tap handle, as a result of which non-uniform operation of the shut-off valve and consequently uncontrolled drink dispensing could take place, the striker limb is guided in a sealed manner along a wall of the outflow channel. Preferably, the dispensing channel extends a few millimeters above the shut-off valve, such as, for example, between 3 and 10 mm. By this means accurate guiding of the outflow (sic) arm can be obtained and thus, controlled operation of the shut-off valve. One or more sealing lips or O-rings can be positioned around the striker limb, which interact with the wall of the outflow channel to provide a seal.

The dispensing head can have an accommodating portion for accommodating an outflow portion of the container that is connected to a flexible dispensing line extending transversely to the axis, the pivot point being positioned close to the accommodating portion. The flexible dispensing line can be accommodated in the container during storage and transport of the container from the manufacturer to the consumer or can be supplied as a separate component for one-off use. When the container is placed in the dispenser, the consumer connects the dispensing line at one end to the outflow channel and at the other end to the tap handle for dispensing drink from the container.

In an alternative embodiment the dispensing head comprises a cylindrical body that can be connected to the container in the extension of the outflow channel, in which body a push rod, running along the axis thereof, is accommodated that emerges from the body at the top, which body is provided at the top with an outflow opening, as well as with a shut-off member connected to the push rod and sliding along the wall of the body for opening and freeing the outflow opening. The dispenser is open at the top for taking a container. For use, the tap handle is connected to the outflow channel and is removed from the container after the container has been emptied. Because the tap handle is not connected to the dispenser in this embodiment it can easily be cleaned.

In a further embodiment of a combination according to the invention the axis of the dispenser is essentially horizontal. As a result the height of the dispensing combination is relatively small and this can be placed in areas of low height, for example on a worktop below kitchen cabinets that are usually present above the worktop.

To ensure that on closing the tap handle after dispensing drink all drink between the dispensing valve and the end of the dispensing line is discharged rapidly and drink does not leak or drip from the dispensing line for a prolonged period, the dispensing line is preferably made short and provided with a vent opening.

Figure 2:
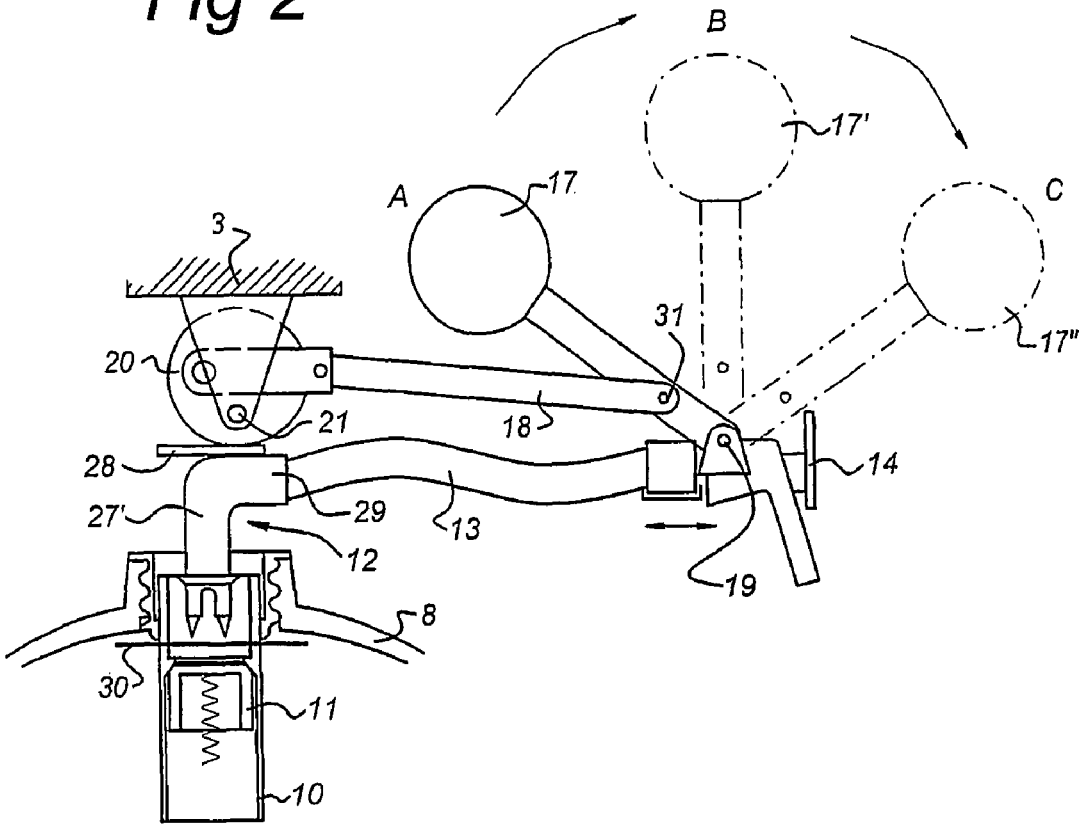
Figure 3:
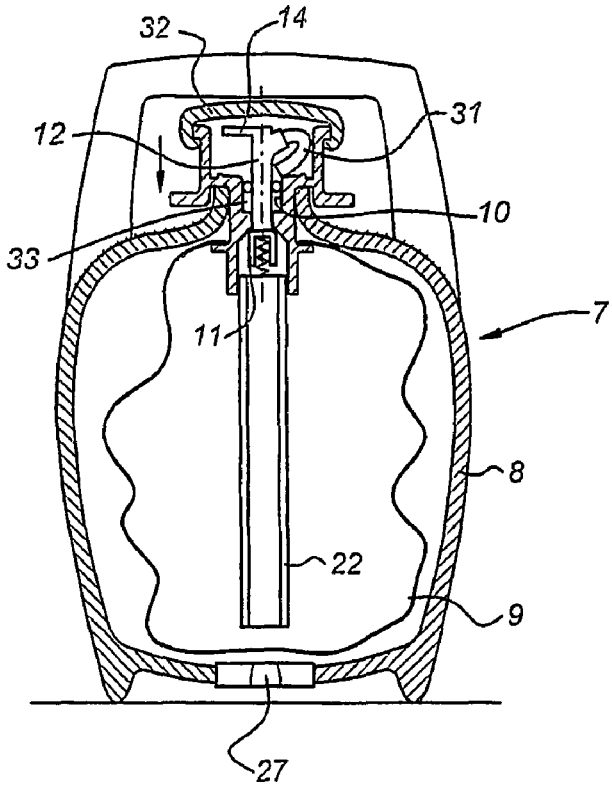
Figure 4:
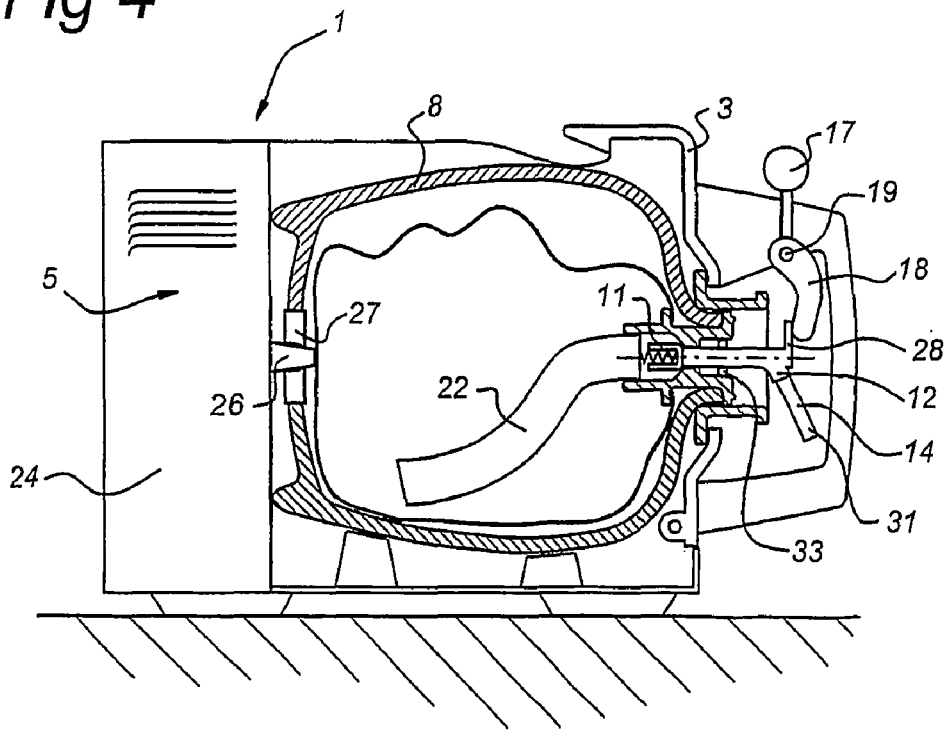
Figure 5:
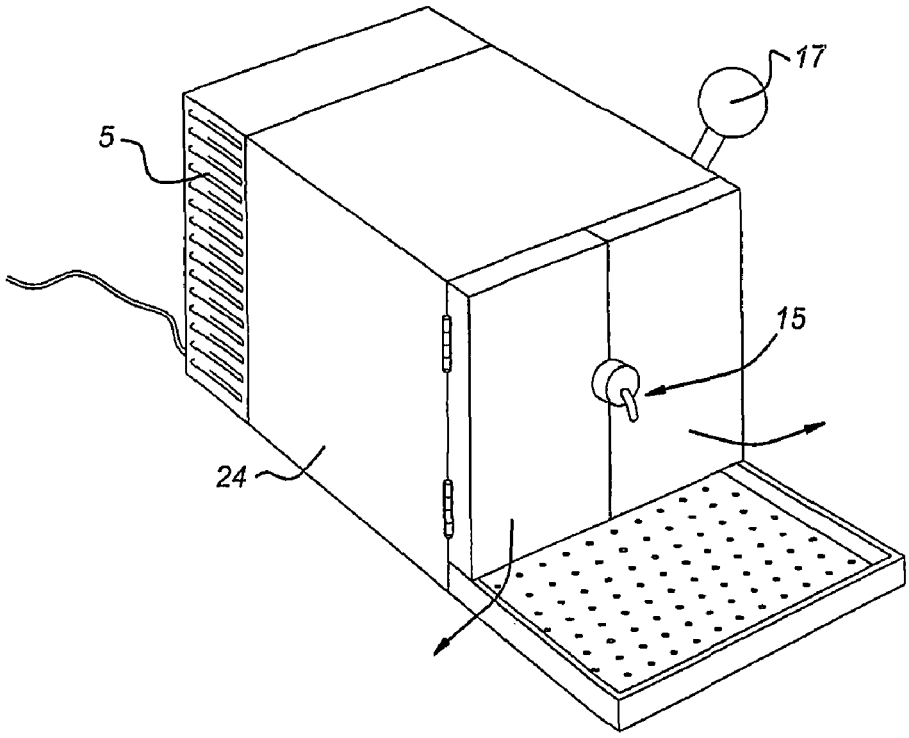
Figure 6:
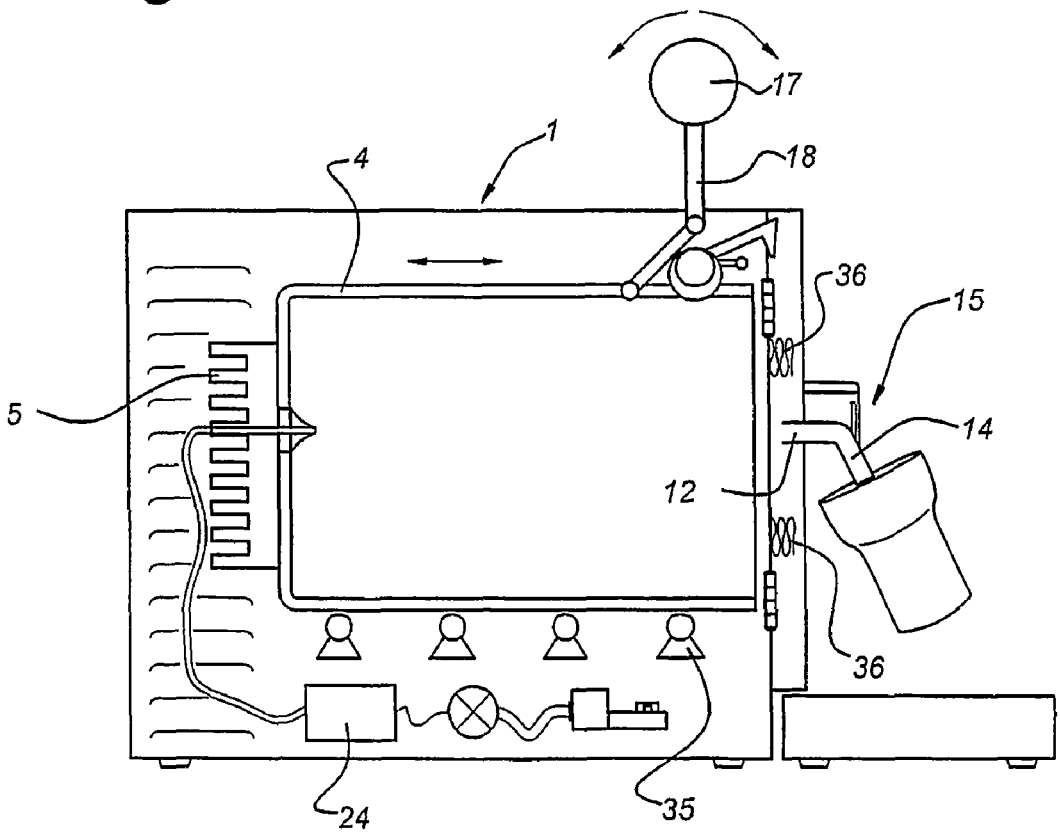
Figure 7:
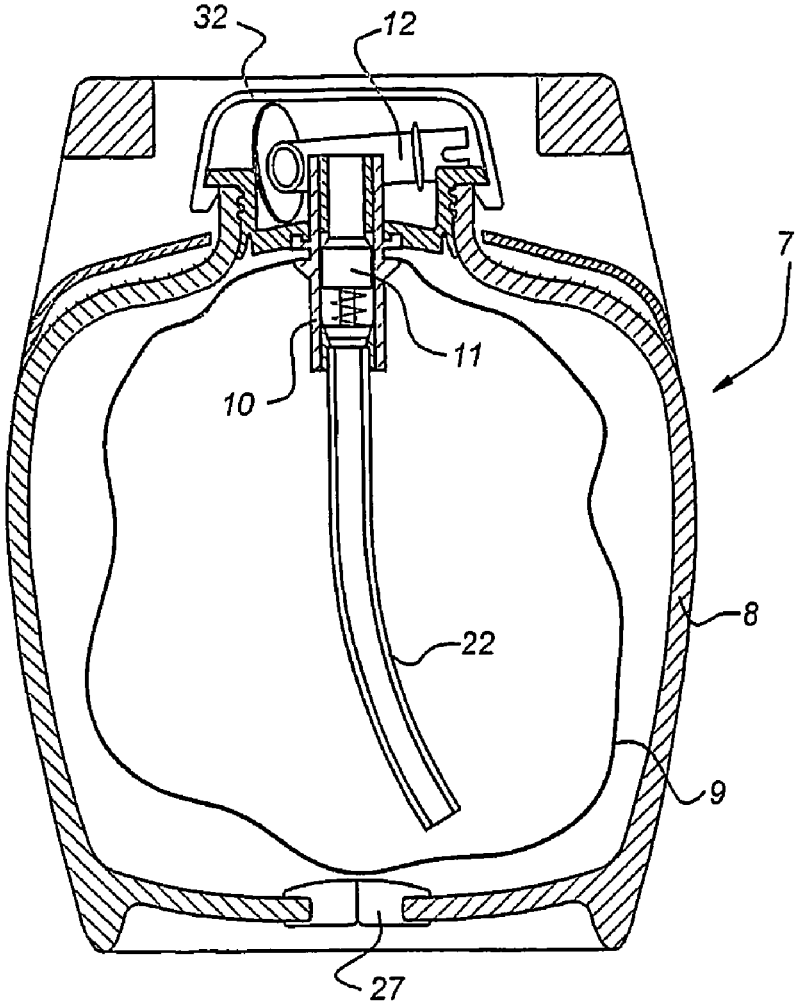
Figure 8:
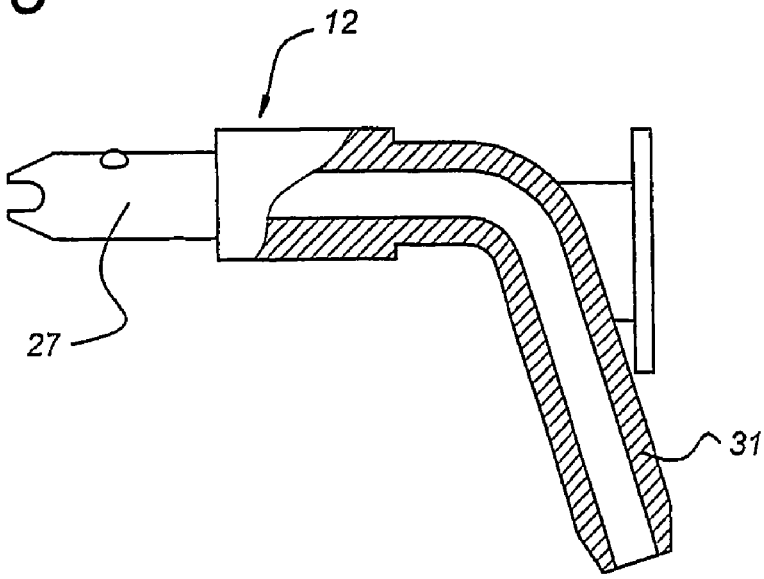
Figure 9:
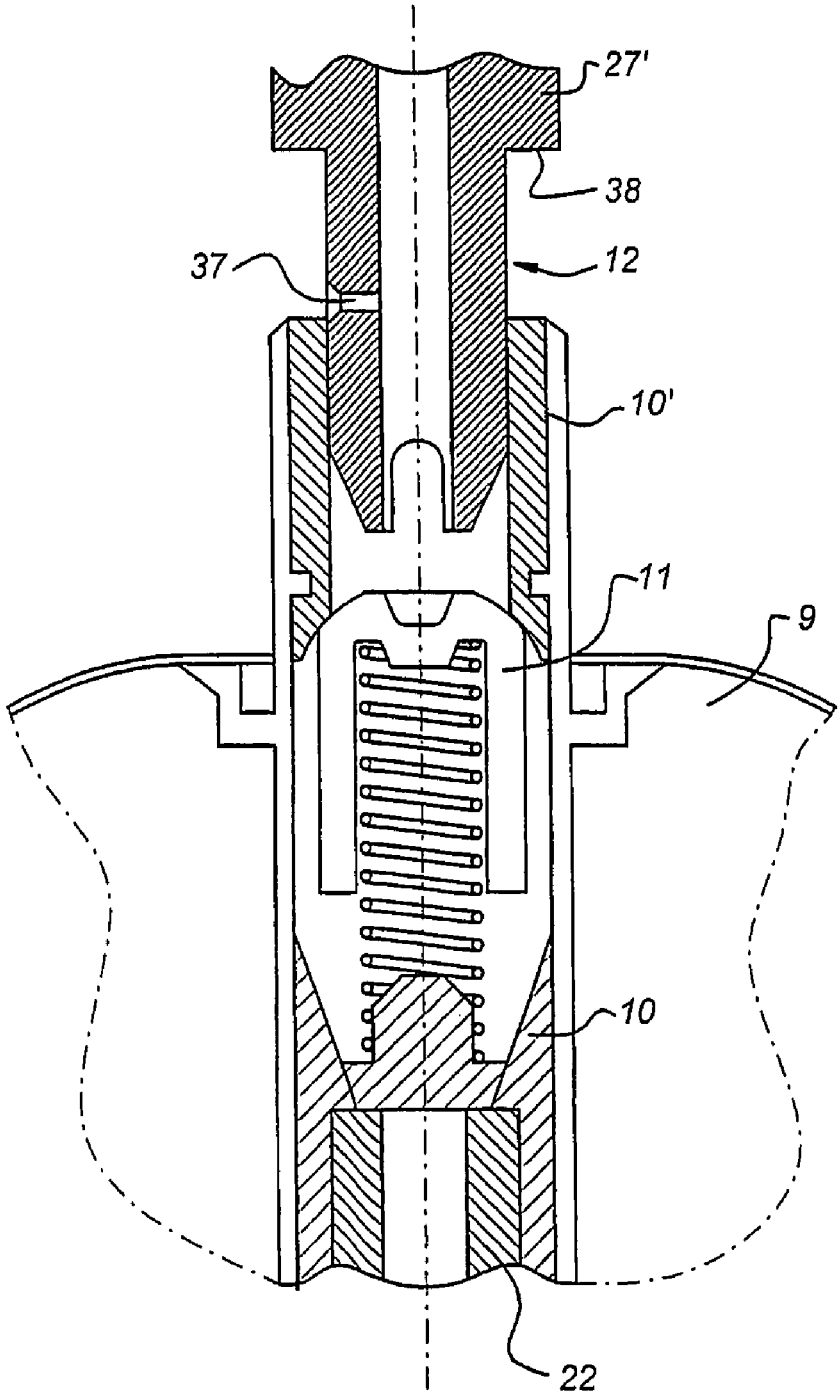
Figure 10:
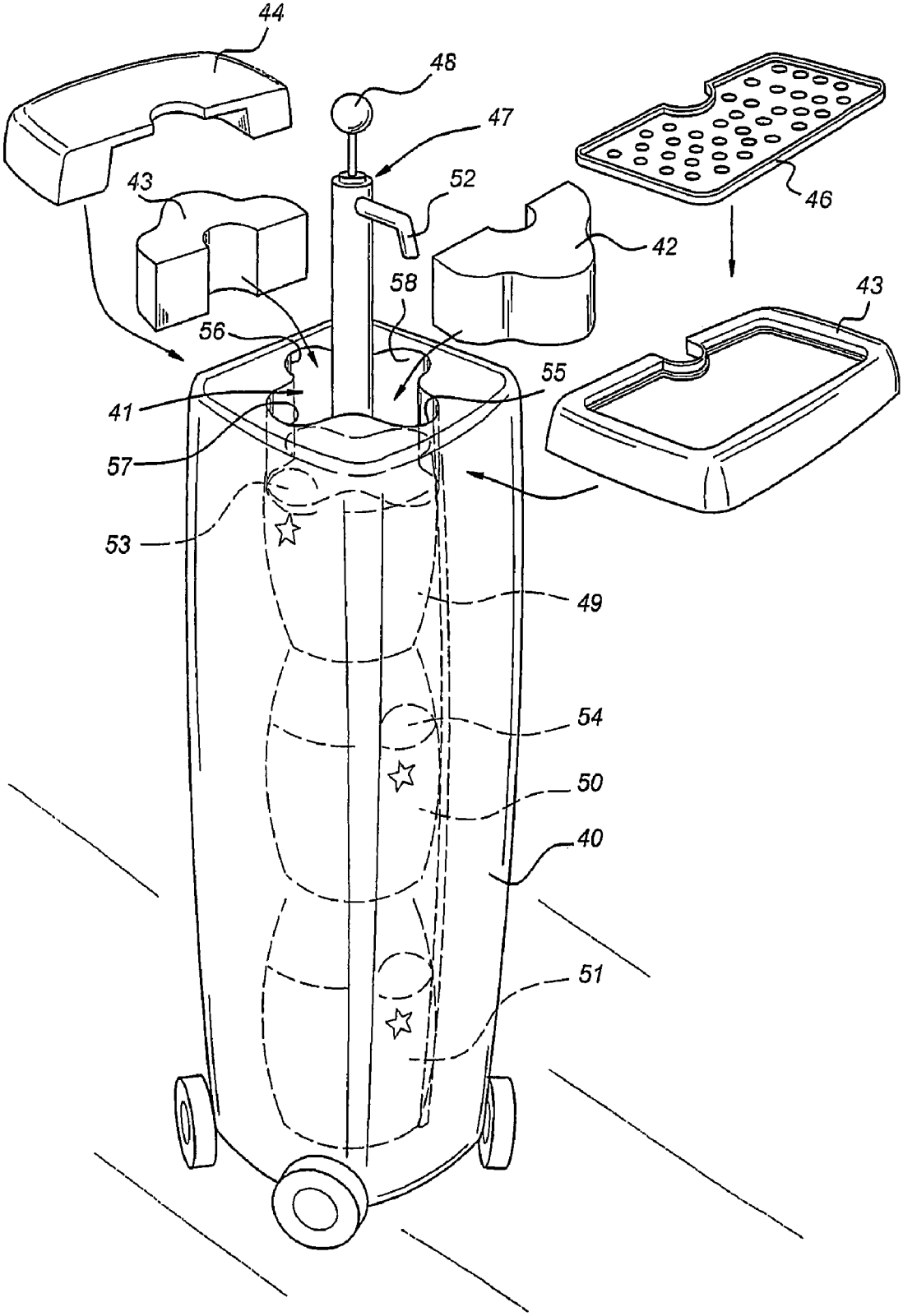

A few embodiments of a dispensing combination according to the invention will be explained in more detail by way of example with reference to the appended drawing. In the drawing:

FIG. 1 shows a longitudinal section through a combination of a drink dispenser and container according to the invention, FIG. 2 shows, diagrammatically, the tap handle, the operating member and an elbow, FIG. 3 and FIG. 4 show a longitudinal section through a combination of dispenser and container that have been placed horizontal during use, FIG. 5 and FIG. 6 show a longitudinal section through an alternative embodiment of a dispenser according to the invention, FIG. 7 shows a longitudinal section of a container for use in the dispenser according to FIG. 5 and FIG. 6, FIG. 8 and FIG. 9 show an elbow and an outflow channel according to the invention, FIG. 10 shows a perspective view of a dispenser with a number of vertically stacked containers therein, and FIGS. (sic) 11 and 12 show a dispensing head for use in the dispenser according to FIG. 9.

In FIG. 1 a drink dispenser 1 is shown with a chill chamber 4 that can be closed off by a lid 3. The chill chamber 4 is made of a thermally conducting material, such as aluminium, and is cooled via a Peltier element 5. When lid 3 is open, a container 7 containing carbonated drink, preferably beer, can be placed in the chill chamber 4 at the top 6 of the dispenser 1. The container 7 is provided with a flexible bag 9 containing the carbonated drink and has an outer jacket 8 made of plastic. At the top of the container 7 there is an outflow channel 10 that can be closed off by a spring-loaded dispensing valve 11. An elbow 12 is accommodated in the outflow channel 10, for which a striker limb 27' is guided vertically through the walls of the channel 10. The elbow 12 is connected by an outflow limb 29 to a dispensing line 13, an outflow end 14 of which, made of plastic, is placed in a tap head 15. The (sic) with this arrangement the elbow 12, the line 13 and the outflow end 14 form an integral whole that is fitted in the outflow channel 10 by the manufacturer or by the user. When the container 7 is placed in the dispenser 1 the outflow end 14 is connected to the tap head 15 in the operating position by the user. The tap head 15 can hinge open for this purpose, as has been described in detail in NL 1019054.

The tap head 15 has a handle 17 that can be rotated about a pivot point 19 in the direction of the arrow. A push rod 18, which engages on an eccentric cam 20 that is mounted on the lid 3 at a pivot point 21, is connected to the handle 17. The eccentric cam 20 is in contact with the elbow 12 and moves the elbow 12 against the spring force of helical spring 16 in the outflow channel 10 on operation of the handle 17 in the direction of the arrow. As a result the contents of the flexible bag 9 can flow via a vertical riser tube 22 into the dispensing channel 13 and, via the dispensing channel 13, to the outflow end 14.

To build up the pressure in the space between the outer jacket 8 and the flexible bag 9, a compressor 24 is provided that is connected via a line 25 to a resiliently mounted air feed 26 in the lid 3. When the lid 3 is closed, the air feed 26 engages on an air inlet 27 in the container 7, which is in communication with the space between the bag 9 and the outer jacket 8.

By operating the handle 17, the elbow 12 can be moved downwards in a simple and reliable manner, so that the dispensing valve 11 is opened. Because, with this arrangement, a vertically oriented striker limb 27' of the elbow 12 is supported over a relatively large portion of its length by the wall of the outflow channel 10, an accurate, vertically oriented movement is possible without skewing, so that the shut-off valve 11 can be brought into a defined position for optimum drink dispensing.

Although the assembly of the elbow 12, the dispensing line 13 and the outflow end can be constructed as a disposable construction, it is also possible to construct the assembly as an assembly for multiple use. Since elbow, dispensing line and outflow end can easily be removed from the dispenser 1 by the user, these can be cleaned thoroughly, which, if the contents of the container 7 are beer, results in an improved taste and longer shelf life. Furthermore, the dispensing line 13 can be made rigid.

FIG. 2 shows the handle 17 and the operating mechanism for the dispensing valve 11 in an embodiment in which three positions can be assumed by the handle. The eccentric cam 20, which can be rotated about pivot point 21, is mounted on the lid 3 and engages on a strike surface 28 of the (sic) elbow 12. the (sic) end of the striker limb 27' of the elbow 12 is provided with a sharp point that is able to puncture a closure seal 30, that closes off the outflow channel 10 before use. When the handle is moved from the position shown at 17 into the upright position 17', this is made ready for tapping and the elbow 12 is moved into the outflow channel 10 to such an extent that the seal 30 is broken, but the valve 11 remains closed. On further rotation of the handle 17 into the position 17" the valve 11 is pushed into the outflow channel 10 against the spring tension and the contents of the container 7 are discharged via the dispensing line 13. When the handle is returned to the position 17', the elbow 12 is withdrawn and the valve 11 closes.

FIGS. (sic) 3 and 4 show an embodiment of a combination according to the invention where similar components are indicated by the same reference numerals as in FIG. 1 and FIG. 2. In the container 7 the elbow 12 is provided with a relatively short mouth 31. Before use, the elbow 12 is on (sic) accommodated in a chamber that is formed by the neck of the container 7 and that is closed off by a lid 32. The dispenser 1 is placed horizontally, as shown in FIG. 4. The light (sic) connection 27 in the container 9 (sic) is located at the bottom and on fitting in the dispenser 1 is connected to the air feed 26. The compressor 24 and the cooling device 5 are positioned to the rear of the dispenser. The handle 17 is connected to the operating member 18, which engages on the strike surface 28 of the elbow 12. By operating the handle 17 the elbow 12 is moved past an O-ring seal 33 in the outflow channel 10. The riser tube 22 has been made flexible in order to able to reach the lowest point in the flexible bag 9 when the container 7 is in the horizontal position, so as to be able to discharge all drink from the bag, as indicated by the broken line in FIG. 4.

In order rapidly to remove all residual drink from the flexible mouth 31 of the outflow end 14 when the dispensing valve 11 is closed, the length of the mouth 31 is relatively short. What is also achieved by this means is that the movement of the mouth on operation of the dispensing valve 11 is slight, so that this movement does not have a disturbing effect when dispensing drink.

FIG. 5 and FIG. 6 show a further alternative embodiment of a horizontally positioned drink dispenser, where the chill chamber 4, together with Peltier cooling element 5, is moved in the housing of the dispenser by operation of the handle 17, in the direction of the arrow indicated diagrammatically. As a result the outflow channel 10 (see FIGS. (sic) 7 and 9) is moved relative to the elbow 12, which remains stationary when dispensing drink. Operation of the handle 17 pulls the chill chamber 4 against the striker limb of the elbow 12, against the spring force of springs 36, 36', until the dispensing valve 11 has opened. When the handle 17 is returned to the vertical position, the chill chamber 4 is released and pushed away from the elbow by the spring force, so that the valve 11 closes. During the relatively short stroke, the chill chamber 4 is guided over bearings 35.

FIG. 7 and FIG. 8 show a container 7 for use in the drink dispenser 1 according to FIG. 5 and FIG. 6. The outflow channel 10 extends above the dispensing valve 10 (sic) over a relatively long length, in order to surround the striker limb 27 of the elbow 12 with a tight fit and to counteract skewing thereof on operation of the handle 17.

As can be seen from FIG. 9, the striker limb 27' of the elbow 12 has a shoulder 38 that delimits the stroke by striking the top edge of the top section 10' of the outflow channel that projects above the valve 11. A vent opening 37 has been made in the striker limb 27' of the elbow 12 such that when the handle 17 (see FIG. 5 and FIG. 6) is placed in the closed position, the vent opening 37 is clear of the wall of top section 10' and the drink present in the elbow can easily flow out of this. When the handle 17 is placed in the dispensing position, the vent opening is closed off by the wall of the top section 10' of the outflow channel 10.

In the embodiment according to FIG. 10, the dispenser has a columnar chill chamber 40 in which a number of, for example three, containers 49, 50 and 51 are stored. The containers can be placed in the column through an opening 41 in the top face thereof. The containers are provided with cheeks 53, 54 projecting sideways. The cheeks 53 of the upper container 49 have been turned through a quarter turn with respect to the cheeks 54 of the lower containers 50, 51 and bear on a mounting 57, 58 at the top of the column, such that the upper container 49 is freely suspended with respect to the containers 50, 51, with its top in a defined position.

The lower containers are lowered into the column 40 by orienting them with respect to the column 40 such that their cheeks 54 pass freely through recesses 55, 56.

After the top container 49 has been placed in the column 40, the tap head 47 is connected via a bayonet fitting to the outflow channel of the container 49 and cooling blocks 42 and 43 are arranged around the tap head 47 to close off the top of the column and to cool the tap head 47. A lid 44 is then fitted, as well as a drip tray 45, that is covered by grating 46.

Figure 11:
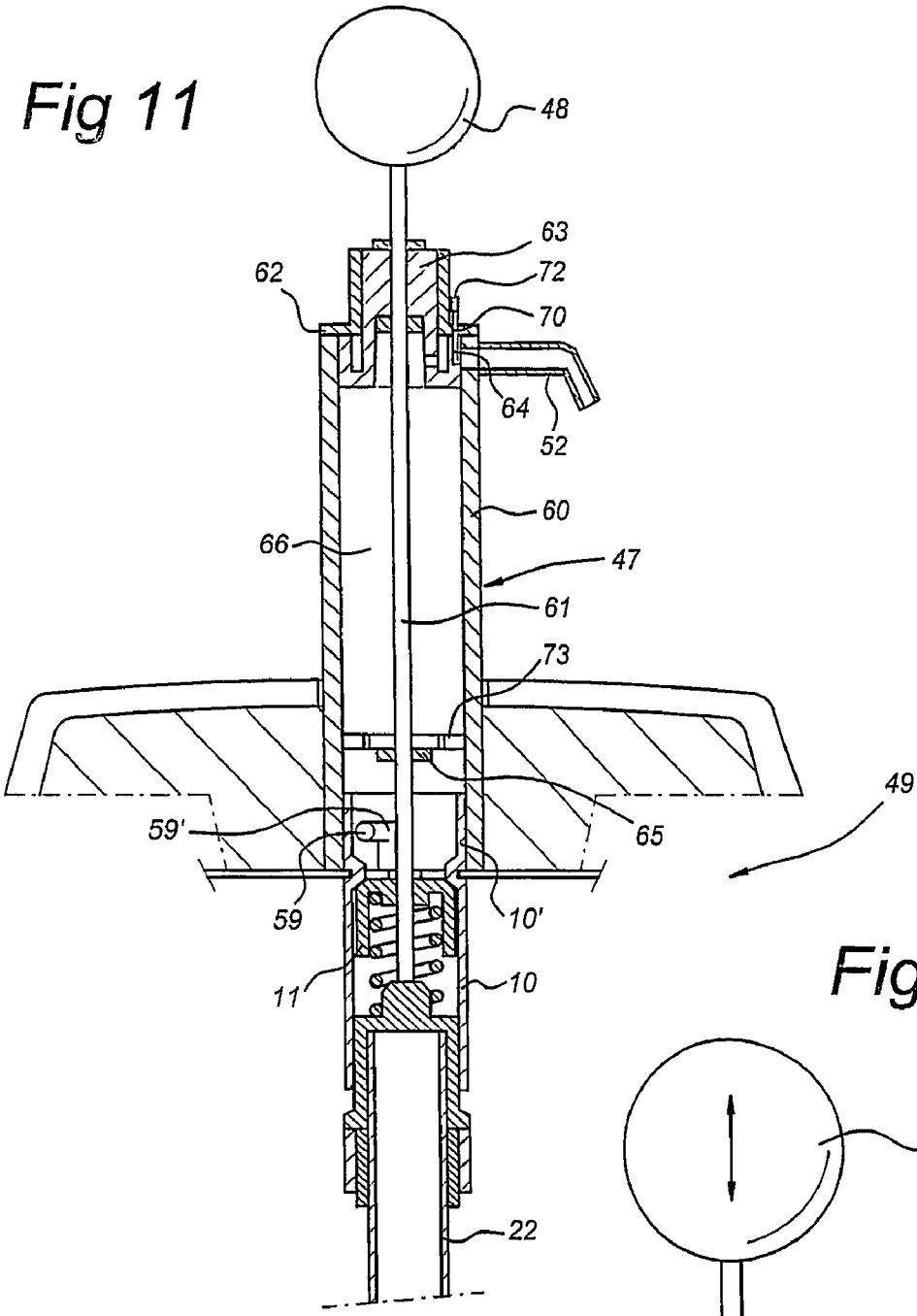
Figure 12:
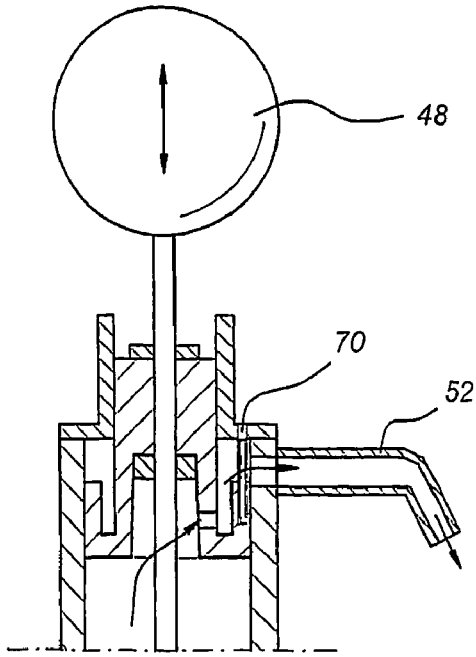

As will be clear from FIG. 11 and FIG. 12, the tap head 47 has a cylinder 60 that is connected to the container 49 via a bayonet connection formed by a slot 59' in the cylinder and a pin 59 on the outer periphery of the top 10' of the outflow channel 10. A push rod 61 is connected to a shut-off valve 63 at the top of the cylinder 60, for closing off and freeing the outflow end 52, and engages on the dispensing valve 11 at the bottom of the cylinder 60. The shut-off valve 63 is provided with a vent channel 64, which, in the closed position as shown in FIG. 10, connects the channel of the outflow end 52 to a vent opening 70. In the open position, as shown in FIG. 11, the vent opening 70 is closed off by a ridge 72 that can be moved with the shut-off valve 63. A handle 48 is connected to the push rod 61. The stroke of the dispensing valve 11 and the force required to open the dispensing valve can be set by movement of a boss 65, which can be moved along the push rod 61 by means of screw thread, with respect to fixed stop 73.

The invention claimed is:

1. A combination of a dispenser (1) and container (7) for carbonated drink, comprising:

an outflow channel (10) provided at a top of the container, extending in a direction of a vertical axis of the container;

a dispensing valve (11), situated at or near the container's vertical axis, closed under spring tension, for dispensing carbonated drink via a dispensing line (12,13,66) connected free of an intermediate shut-off valve to the outflow channel, the dispenser being provided with a chill chamber (4,40) for accommodating the container; and a dispensing head (15,47) with a handle (17,48), situated at a distance from the container's vertical axis, the handle is connected to an operating member (12,18,20,61) extending transversely to the container's vertical axis from the handle (17,48) to the dispensing valve (11), wherein upon movement of the handle, movement is transferred via the connection to move the operating member along the container's vertical axis in order to open and to close the dispensing valve (11) while the dispensing line remains unobstructed.

2. The combination according to claim 1, wherein the container (7) has a dispensing line (13,14) with an elbow (12), a striker limb (27') of which can be moved in the outflow channel (10), which elbow is provided with an outflow limb (29), as well as a strike surface (28), wherein the dispensing head (15,47) is provided with a pivot point (19), located some distance away from the container's vertical axis, about which the handle (17) can be moved and wherein the operating member comprises a push body (18) which is connected to the handle and engages on the strike surface.

3. The combination according to claim 2, wherein the striker limb (27') is guided in a sealed manner along a wall (10') of the outflow channel (10) that extends above the dispensing valve (11) in the direction of the container's vertical axis.

4. The combination according to claim 1, wherein the dispensing head (15) has an accommodating portion for accommodating an outflow portion of the container that is connected to a flexible dispensing line (13) extending transversely to the container's vertical axis and wherein the pivot point (19) is positioned close to the accommodating portion.

* * * * *